United States Patent [19]

Sugawara

[11] Patent Number: 4,817,281

[45] Date of Patent: Apr. 4, 1989

[54] FLAT CABLE BRANCHING AND CONNECTING PROCESS

[75] Inventor: Naoto Sugawara, Sagamihara, Japan

[73] Assignee: Minnesota Mining and Manufacturing Company, St. Paul, Minn.

[21] Appl. No.: 168,182

[22] Filed: Mar. 15, 1988

[51] Int. Cl.[4] ..... H01R 43/00

[52] U.S. Cl. ..... 29/857; 174/117 F; 439/98; 439/494; 439/497; 29/863

[58] Field of Search ..... 29/857, 863; 174/117 F, 174/117 FF, 36; 439/98, 497

[56] References Cited

U.S. PATENT DOCUMENTS 4,152,826 5/1979 Mueller ..... 439/497 X
4,232,444 11/1980 Bolick, Jr. ..... 29/863
4,379,361 4/1983 Webster et al. ..... 174/117 F X
4,662,700 5/1987 Markham ..... 29/866 X

FOREIGN PATENT DOCUMENTS

81/00491 2/1981 European Pat. Off. ..... 439/494

*Primary Examiner*—Carl J. Arbes
*Attorney, Agent, or Firm*—Donald M. Sell; John C. Barnes

[57] ABSTRACT

Making a branch connection with a flat cable and affording shielding is afforded by removing insulation at three longitudinally spaced locations transversely of the cable, folding the cable at the intermediate location, making connection to the signal leads at the intermediate location, cutting ground leads, folding ground leads at other two locations, and joining a portion of a conductive member to the ground leads on each side of the cable and by straps at the fold joining the portions of the conductive member affording ground contacts.

1 Claim, 7 Drawing Sheets

FLAT CABLE BRANCHING AND CONNECTING PROCESS

BACKGROUND OF THE INVENTION

1. Field of the Invention

The present invention relates to a method of forming branch connection with a flat cable, and in particular to a method of forming electrical connections for connecting an intermediate portion of, for example, a high-speed signal transfer cable to contacts of a connector for branching connection.

2. Description of the Prior Art

Hitherto, to connect intermediate portions of a high-speed signal transfer cable to a connector for branch connection, the cable was cut into two portions 101, 102 as shown in FIG. 14, the leads 101*a*, 101*b*, 101*c*, . . . , 102*a*, 102*b*, 102*c*, . . . , of respective cables 101, 102 being exposed at the cut ends 103, 104 of these cable portions 101, 102; pairs of corresponding leads 101*a*, 102*a*; 101*c*, 102*c*, . . . , are electrically connected to the end portions of respective contacts 105, 106, 107, . . . , by means of, for example, soldering.

When respective pairs of two signal transfer leads of high-speed signal transfer flat cables are electrically connected to the connecting ends of corresponding contacts in accordance with the above described conventional branch connection forming method, short-circuits or imperfect connections tend to occur since many signal lines without any insulating coating as well as the earth lines are made to cross with each other in a complicated manner.

The present invention has been made in view of the above mentioned point, and an object thereof is to provide a method which makes it possible to form good branch connections of a flat cable easily and securely, and which further makes it possible to reduce the variation in the impedances, even for high-speed signals or signals having very high frequency components, at the branch connections of a transfer system.

SUMMARY OF THE INVENTION

According to the present invention, the above mentioned object is achieved by a method of forming branch connection of a flat cable, comprising the steps of:

removing an insulation coating of a flat cable in a transverse direction relative to the flat cable at three longitudinal portions thereof, thereby exposing all of the leads of the flat cable at said three portions; folding the flat cable at the intermediate exposed lead portion of said three portions; causing each of the earth leads of the leads of the flat cable at the exposed portions to project toward a nearer surface; causing the signal leads of the leads of the flat cable at the exposed lead portions to project toward the folded ends thereof keeping the folded condition thereof; electrically connecting the earth leads on both surfaces of overlapped portions to a common earth lead connecting means at said both surfaces; and electrically connecting each of the folded projecting portions of the signal leads and of the common earth lead connecting means to a corresponding connection terminal of branch signal output means.

In accordance with the method of the present invention, each of the earth leads among the leads of a flat cable is caused to project to and from the nearer surface side of overlapped portions, the earth leads on both surfaces of the overlapped portions are electrically connected on said both surfaces to a common earth lead connecting means, and signal leads among the leads of the flat cable at the folded exposed lead portions are caused to project to and from their folded end side in the folded condition without being cut, whereby the earth leads and signal leads can be securely spaced apart and only the signal leads are caused to project to the folded end side, so that there is little fear of short circuiting or imperfect connections between the signal leads and thus good branch connections can be formed.

BRIEF DESCRIPTION OF THE DRAWING

The preferred embodiment of the present invention will be described with reference to the drawings wherein.

DESCRIPTION OF THE PREFERRED EMBODIMENT

Figure 1:
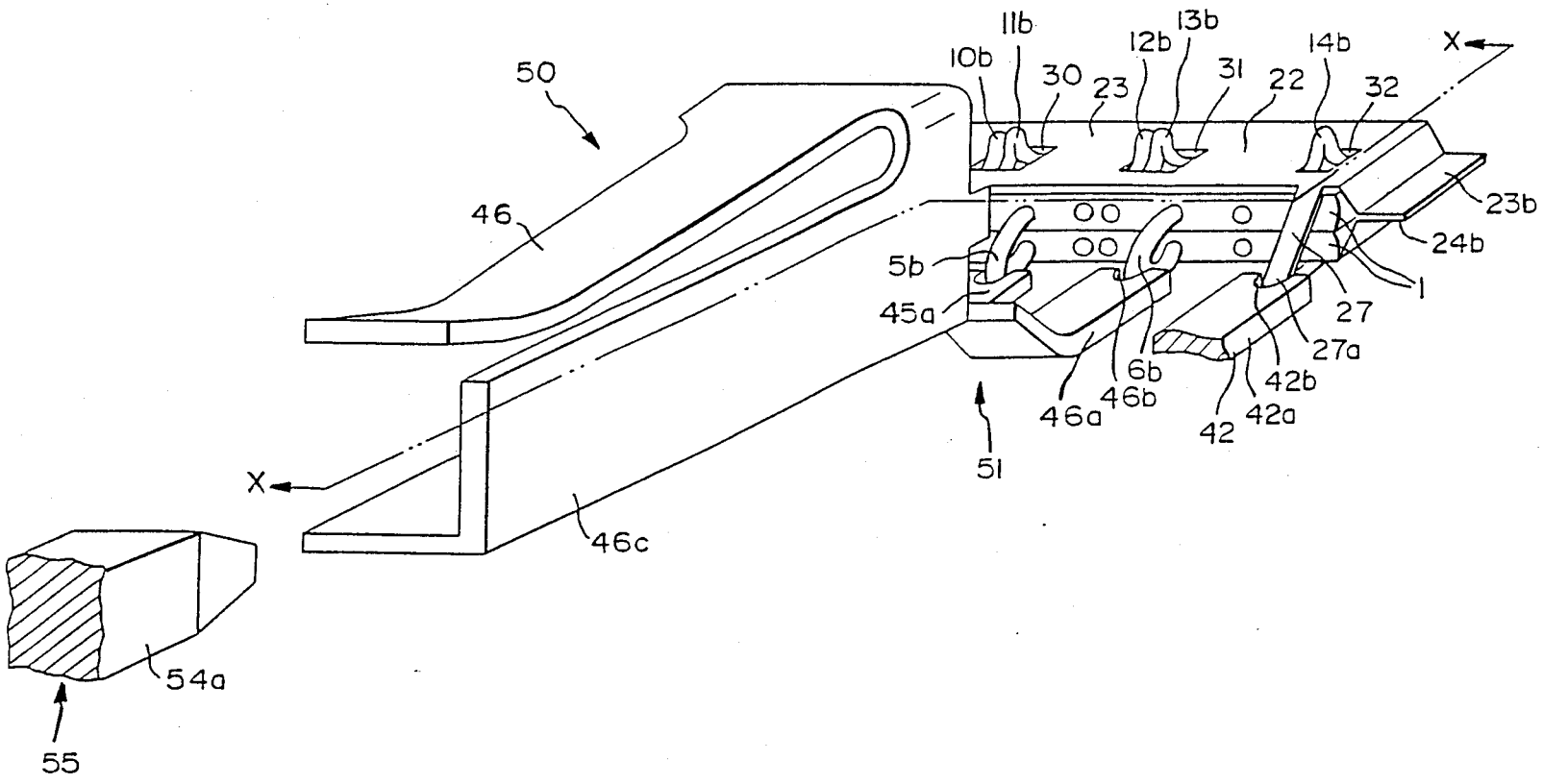
FIG. 1 is an enlarged perspective view illustrating the branch connection structure of a flat cable formed by a preferred embodiment of the method of forming branch connections with a flat cab,le according to the present invention.
Figure 2:
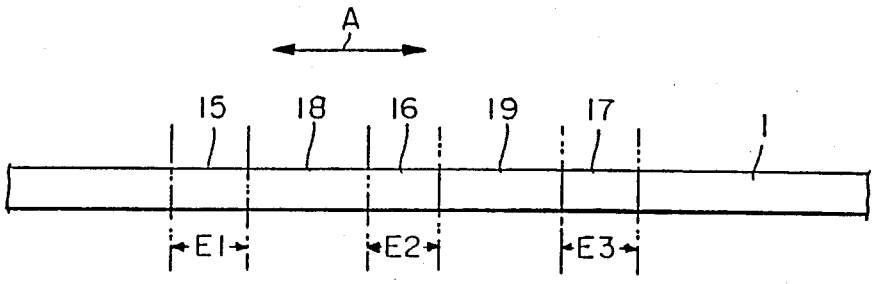
FIGS. 2 through 5 are explanatory views illustrating the steps of processing the flat cable for forming the structure of FIG. 1.
Figure 3:
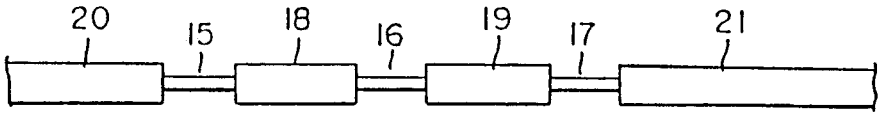

In FIGS. 1 through 13, 1 represents a flat cable for signal transfer between high-speed signal processing units such as computers and their peripheral processing units, an insulating or dielectric coating 2 of the flat cable 1 having embedded therein a large number (generally up to 50–60, but, for simplicity the following description will be given in conjunction with the drawings as to the case of four) of signal transfer leads 3, 4, 5, 6 and twice as many earth leads 7, 8, 9, 10, 11, 12, 13, 14 as the signal transfer lead is located between a pair of earth leads in order that cross-talk of the signals between the signal lines may be suppressed.

Figure 6:
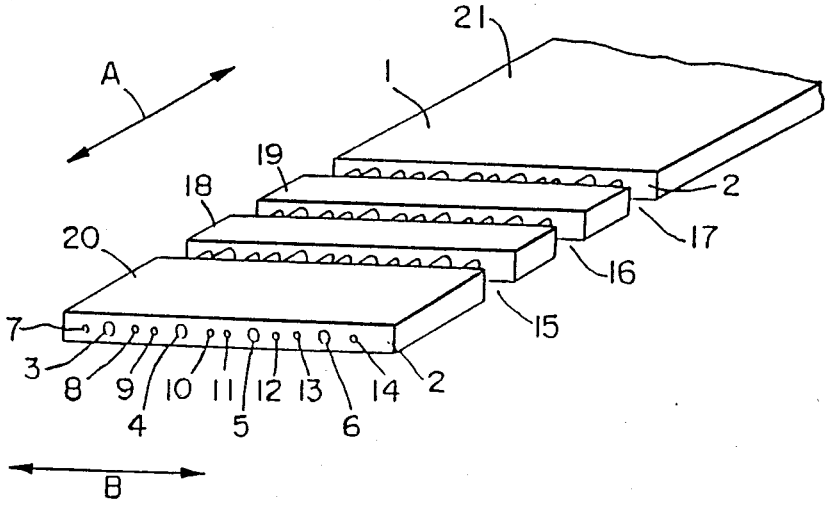
FIG. 6 is a perspective view of the flat cable of FIG. 3.
Figure 7:
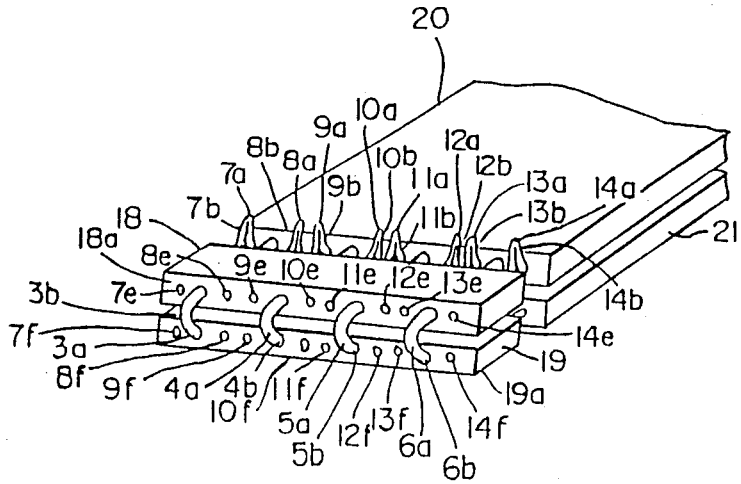
FIG. 7 is a perspective view of the flat cable of FIG. 5.
Figure 8:
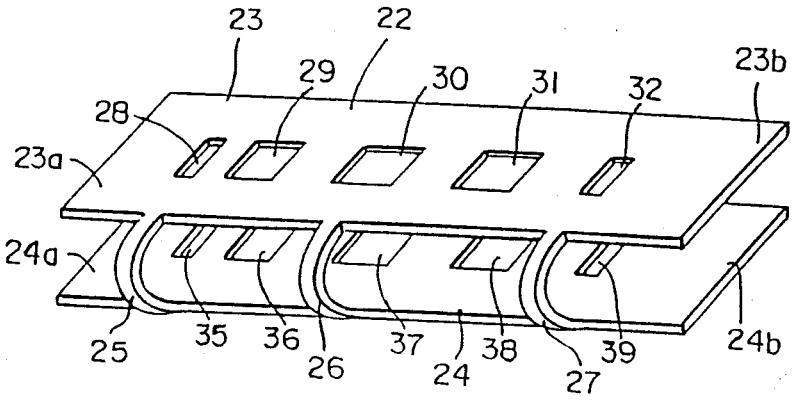
FIG. 8 is a perspective view of a common earth plate to be mounted on the flat cable under the processed condition of FIGS. 5 and 7.
Figure 9:
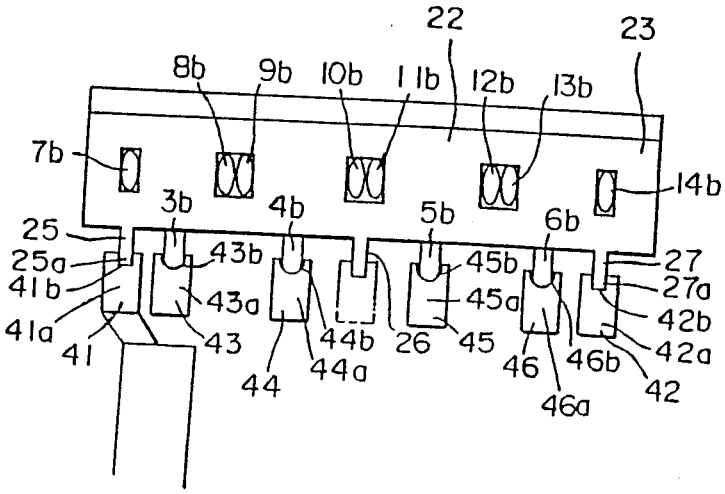
FIG. 9 is plan view of the structure of FIG. 1.
Figure 10:
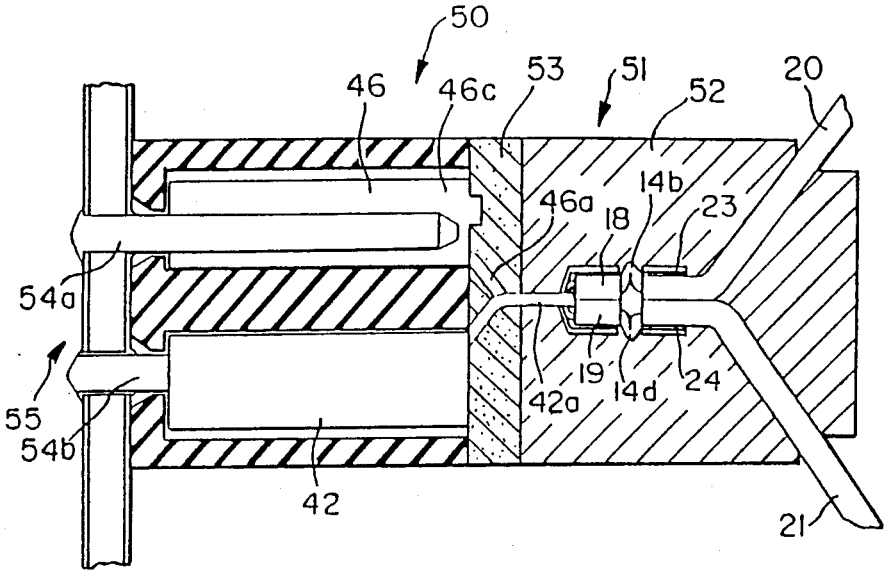
FIG. 10 is a cross sectional view of the structure of FIG. 1 taken along the line X—X.

First, in the intermediate portion of the flat cable 1, the insulating coating 2 is removed in the transverse direction B, see FIG. 6, at three portions 15, 16, 17 which are equally spaced apart in the longitudinal direction A of the flat cable 1. The insulating coating 2 may also be removed at more than three portions, for example, at five or seven portions. To remove the insulating coating, a laser such as a $CO_2$ laser may be used; alternatively, any mechanical, chemical or thermal means may be used. Further, the exposed lead lengths E1, E2 and E3 at the portions 15, 16 and 17, are usually E1=E3, but, if desired, E1≠E3. If the position of insulating coating portions 18, 19 can be adjusted in the longitudinal direction of the leads, the extent of each of E1, E2 and E3 may be arbitrary selected, if E1+E2+E3 may be of any desired extent.

The removal of the insulation coating removes all insulation coating at the portions 15, 16 and 17, exposing all the signal leads 3 through 6 and earth leads 7 through 14 thereat.

Next, the flat cable 1 is folded at the intermediate lead exposed portion 16 in a manner such that the insulation coating residual portions 18, 19 and insulation coating portions 20, 21 on both sides, as well as the exposed lead portions 15, 17, are overlapped on one another (exposed portions 15, 17 may be positioned in a not overlapped but shifted manner). Then, the earth leads 7 through 14 are cut at their portions which correspond to the exposed portion 16. Such cutting of the earth leads 7 through 14 may be done before or after the folding, and in some case it may be done simultaneously with the said removal of the insulation coating.

Figure 4:
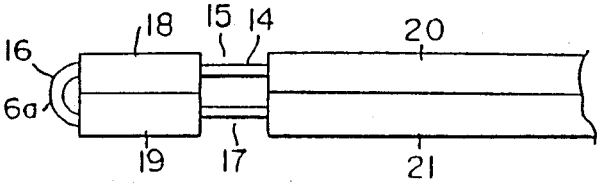
Figure 5:
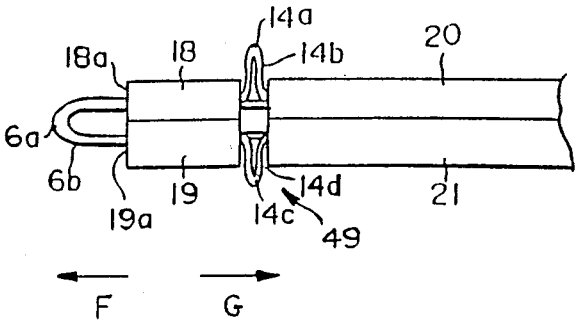

Next, the folded ends 3*a*, 4*a*, 5*a*, 6*a* of the respective signal lead 3, 4, 5, 6 are forced, without being cut, to project in the direction F, see FIG. 5, out of the insulation coating portions 18, 19 to form electrical connections 3*b*, 4*b*, 5*b*, 6*b*, of the signal leads; earth lead portions 7*a*, 8*a*, 9*a*, 10*a*, 11*a*, 12*a*, 13*a*, and 14*a* at the exposed portion 15, which are located on the upper side in FIG. 1 or in FIGS. 4 and 5 are pulled to project upwardly to form projections 7*b*, through 14*b* for electrical connection; earth lead portions 7*c* through 14*c* at the exposed portion 17, which are located on the lower side in FIGS. 4 and 5, are pulled to project downwardly to form projections 7*d* through 14*d* for electrical connection (lead portions 7*c* through 14*c* and 7*d* through 14*d* are similar to 7*a* through 14*a* and 7*b* though 14*b* and thus are not shown). In this case, the folded electrical connections 3*b* through 6*b* of the signal leads and the projection connections 7*b* through 14*b*, 7*d* through 14*d* of the earth leads are securely insulated and isolated from each other by insulation coating residual portions 18, 19 of the cable 1.

More specifically, when the projecting electrical connections 3*b*, 4*b*, 5*b*, 6*b* of the signal leads are formed, the insulation coating portions 18, 19 are displaced toward the insulation coating portions 20, 21 in a direction G, see FIG. 5, and the folded portions 3*a*, 4*a*, 5*a*, 6*a* of the corresponding leads 3, 4, 5, 6 are drawn out of the insulation coating portions 18, 19 in the direction F without being cut. This makes the gaps 49 between the insulation coatings residual portions 18, 19 and the insulation coating portions 20, 21 significantly narrower than the original extent E1 or E3 of the exposed regions 15, 17, interference being unlikely to occur between the signal leads 3, 4, 5, and 6 within the gap 49. On the other hand, when the earth projection lead portions 7*b* through 14*b*, 7*d* through 14*d* are formed, the lead portions 7*a* through 14*a* are pulled in the direction G relative to the insulation coating portion 18 until their cut ends 7*e* through 14*e* reach the end face 18*a* of the insulation coating portion 18, while lead portions 7*c* through 14*c* are pulled in the direction G relative to the insulation coating portion 19 until their cut ends 7*f* through 14*f* reach the end face 19*a* of the insulation coating portion 19. In this connection, the cut ends 7*e* through 14*e*, 7*f* through 14*f* are preferably retracted from the end faces 18*a*, 19*a*.

Then, the folded and overlapped end of the flat cable 1 is covered with an electrically conductive cover 22 for a common earth ground as the common earth lead connecting means. This cover 22 is formed by punching or blanking a thin metal plate of, for example, a copper alloy, and comprises a flat plate portion 23 located on the insulation coating portions 18, 20, a flat plate portion 24 located on the outer surfaces of the insulation coating portions 19, 21, and folded connecting portions 25, 26, 27. Further, the cover 22 may also be constituted by a sheet-like member of a material such as plastics which is highly electrically insulating even for high frequency signals and which has a thin metal layer of, for example, copper formed on one surface (outer surface) thereof. The flat plate portion 23 has openings 28, 29, 30, 31, 32 formed therein, into which earth projections 7*b*, 8*b*, 9*b*, 10*b*, 11*b*, 12*b*, 13*b*, and 14*b* are inserted, while the flat plate portion 24 has openings 33, 34, 35, 36, 37 formed therein, into which earth projections 7*d*, 8*d*, 9*d*, 10*d*, 11*d*, 12*d*, 13*d*, 14*d* are inserted. Further, instead of one opening 29 into which earth projections 8*b*, 9*b* are inserted, small openings for individual insertion of them may be provided in the flat plate portion 23. The corresponding earth projections 7*b* through 14*b*, 7*d* through 14*d* inserted into respective openings 28 through 39 are fixedly electrically connected to the openings 28 through 39 by soldering, for example. Further, both side edge portions 23*a*, 24*a* and 23*b*, 24*b* are rigidly fixed together by means of, for example, welding, in order to place the overlapped insulation coating portions 18, 19 and 20, 21 in close contact with each other in the overlapping direction, to prevent the relative displacement of the insulation coating portions 18, 20 and 19, 21 in the direction along the overlapped surfaces, and to prevent the relative displacement among the signal lines such as lines 3, 4, 5 and 6 in the gap 49. Further, the gap 49 may be filled with an electrically insulating resin, for example, to fix the signal lines such as lines 3, 4, 5, and 6 therein before or at a time of the mounting of this common earth cover 22. At least one of the coupling portions 25, 26, 27, for example the coupling portions 25, 27 on both sides, are engaged with connecting ends 41*a*, 42*a* of the contacts 41, 42 of a branch connection forming connector 50 as a branch signal output means having recesses 41*b*, 42*b* complementarily shaped to closely engage with the projecting ends 25*a*, 27*a* of the coupling portions 25, 27, and are easily and securely electrically connected and fixed by suitable means such as soldering. Further, as shown by imaginary lines in FIG. 9, the intermediate coupling portion 26 may also be electrically connected to another similar connecting end.

On the other hand, the projecting electrically connecting portions 3*b*, 4*b*, 5*b*, 6*b* of the signal leads extend substantially in a parallel manner such that desired gaps can be formed therebetween, and they are engaged with recesses 43*b*, 44*b*, 45*b*, 46*b* at connecting ends 43*a*, 44*a*, 45*a*, 46*a* of contacts 43, 44, 45, 46 of the branch connection forming connector 50, which recesses are similar to the recesses 41*b*, 42*b* of the connecting ends 41*a*, 42*a* of the contacts 41, 42 and are easily and securely electrically connected by means of soldering, for example. Further, the connecting ends 43*a* through 46*a* electrically connected to the projecting electrically connecting portions 3*b*, 4*b*, 5*b*, and 6*b* of the signal leads may have suitable engaging structures such as holes instead of the recesses.

An intermediate or branching connection portion 51 of the flat cable 1 constructed in the above mentioned manner is embedded in the resin 52, 53 using, for example, a suitable forming die such that it can be made integral with the connector 50.

Figure 11:
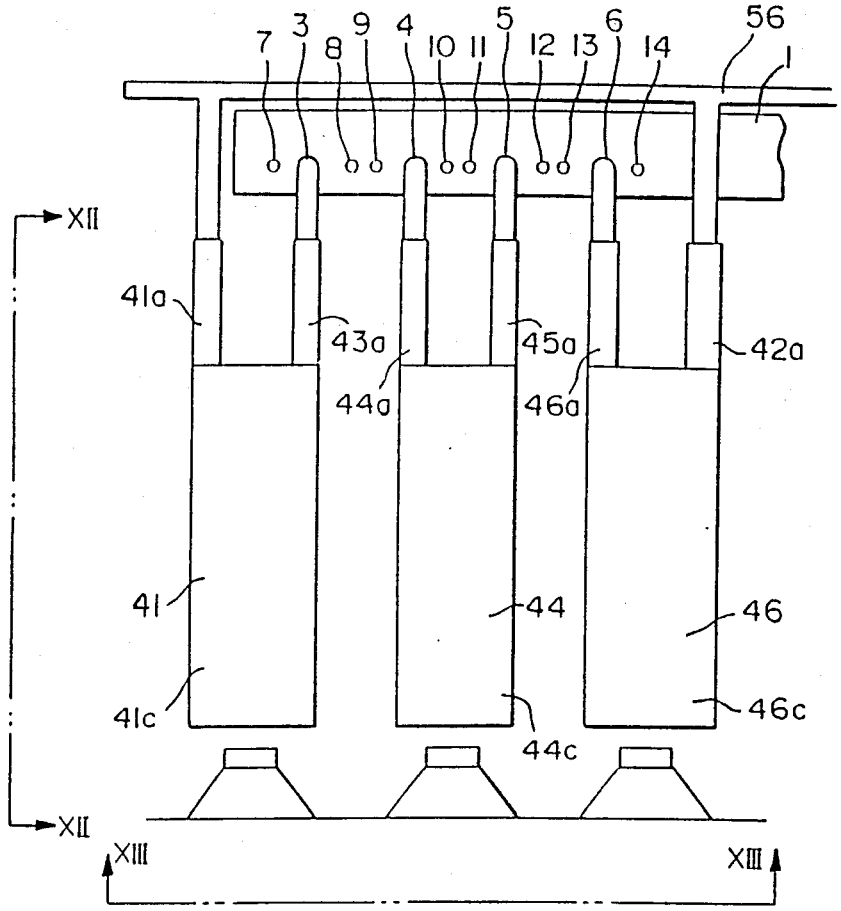
FIG. 11 is plan view of the connection, to the female-type connector, of the structure of FIG. 1.
Figure 14:
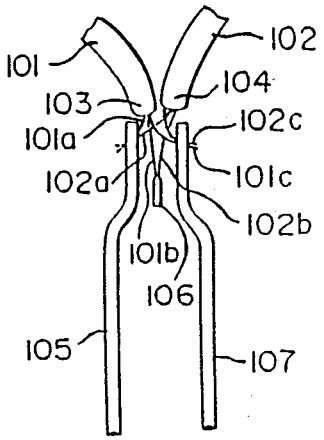
FIG. 14 is a cross sectional view of the branch connection structure formed in accordance with a prior art method of branch connection with a cable.
Figure 12:
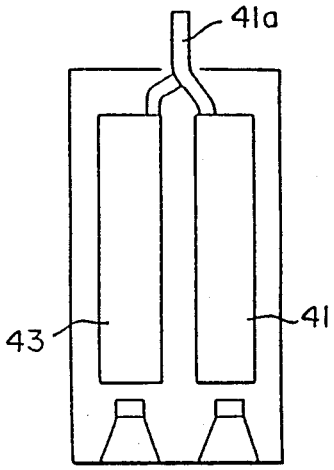
FIG. 12 is a side view as viewed along lines XII—XII of FIG. 11.
Figure 13:
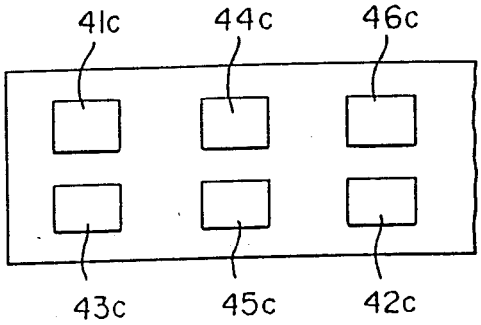
FIG. 13 is a bottom view as viewed along lines XIII—XIII of FIG. 11.

The contacts 41, 42, 43, 44, 45, and 46 of the connector 50 have female-type contact portions 41*c*, 42*c*, 43*c*, 44*c*, 45*c*, and 46*c*, see FIG. 11, on the side opposite to the connecting ends 41*a*, 42*a*, 43*a*, 44*a*, 45*a*, and 46*a*. Further, 54*a*, 54*b*, etc., represent the contacts of a male-type connector 55, see FIG. 10, for engagement with the female-type contacts 41 through 46 of the connector 50.

Although, the connector 50 as the branching signal output means is described to be a female type connector in the explanations above, the branch signal output means may be a male-type connector or any other signal output mechanisms.

What is claimed is:

1. A method of forming branch connection of a flat cable, having earth leads and signal leads comprising the steps of:

removing an insulation coating of a flat cable in a transverse direction relative to the flat cable at three longitudinal portions thereof, thereby exposing all of the leads of the flat cable at said three portions;

folding the flat cable at the intermediate exposed lead portion of said three portions;

cutting the earth leads of the flat cable at the intermediate exposed lead portions;

causing each of the earth leads of the flat cable at the exposed portions to project toward and beyond an outside surface of the folded cable;

causing the signal leads of the leads of the flat exposed lead portions to project toward the folded ends thereof keeping the folded condition thereof;

electrically connecting the earth leads on both surfaces of overlapped portions to a common earth lead connecting means at said both surfaces; and electrically connecting each of the folded projecting portions of the signal leads and of the common earth lead connecting means to a corresponding connection terminal of branch signal output means.

* * * * *

UNITED STATES PATENT AND TRADEMARK OFFICE

CERTIFICATE OF CORRECTION

PATENT NO. : 4,817,281

DATED : April 4, 1989

INVENTOR(S) : Naoto Sugawara

It is certified that error appears in the above-identified patent and that said Letters Patent is hereby corrected as shown below:

Column 2, line 19 "cab,le" should read —cable—.

Column 5, line 22, after "cable" delete "," and insert --,-- after "leads" (second occurrence).

Column 6, line 6, delete "the" (second occurrence) and substitute —an—.

Column 6, line 13, after "flat" insert —cable at the—.

Signed and Sealed this

Twenty-seventh Day of November, 1990

*Attest:*

HARRY F. MANBECK, JR.

*Attesting Officer*

*Commissioner of Patents and Trademarks*